US009141071B2

(12) United States Patent
Adachi et al.

(10) Patent No.: US 9,141,071 B2
(45) Date of Patent: Sep. 22, 2015

(54) IMAGE FORMING APPARATUS PROVIDED WITH CLEANING MEMBER CAPABLE OF RELIABLY CLEANING IMAGE BEARING MEMBER

(71) Applicants: Aya Adachi, Nagoya (JP); Masatoshi Shiraki, Nagoya (JP)

(72) Inventors: Aya Adachi, Nagoya (JP); Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/167,577

(22) Filed: Jan. 29, 2014

(65) Prior Publication Data

US 2014/0212158 A1 Jul. 31, 2014

(30) Foreign Application Priority Data

Jan. 31, 2013 (JP) ..... 2013-017861

(51) Int. Cl.

| | |
|---|---|
| ***G03G 21/10*** | (2006.01) |
| ***G03G 21/06*** | (2006.01) |
| ***G03G 21/00*** | (2006.01) |
| *G03G 15/16* | (2006.01) |

(52) U.S. Cl.

CPC ..... *G03G 21/0064* (2013.01); *G03G 15/1675* (2013.01); *G03G 2215/0141* (2013.01)

(58) Field of Classification Search

CPC ..... G03G 15/1645

See application file for complete search history.

(56) References Cited

U.S. PATENT DOCUMENTS

| | | | | |
|---|---|---|---|---|
| 6,192,204 | B1 * | 2/2001 | Yagi et al. | 399/66 |
| 2004/0042813 | A1 * | 3/2004 | Takai | 399/88 |
| 2012/0251139 | A1 * | 10/2012 | Handa | 399/44 |
| 2012/0288292 | A1 * | 11/2012 | Kojima | 399/51 |

FOREIGN PATENT DOCUMENTS

JP H08-95453 A 4/1996

* cited by examiner

*Primary Examiner* — Clayton E Laballe
*Assistant Examiner* — Leon W Rhodes, Jr.
(74) *Attorney, Agent, or Firm* — Banner & Witcoff, Ltd.

(57) ABSTRACT

An image forming apparatus includes: an image forming unit; and a controller. The image forming unit includes: an image bearing member; a charging member; a transfer member; and a cleaning member. The controller selectively applies first and second transfer biases to the transfer member. A first transfer current flows between the image bearing member and the transfer member upon application of the first transfer bias. A second transfer current flows therebetween upon application of the second transfer bias. The controller selectively applies first and second charging biases to the charging member. The image bearing member has a first surface potential upon application of the first charging bias, and a second surface potential upon application of the second charging bias. The controller applies the first charging bias when applying the first transfer bias, and applies the second charging bias when applying the second transfer bias.

10 Claims, 6 Drawing Sheets

IMAGE FORMING APPARATUS PROVIDED WITH CLEANING MEMBER CAPABLE OF RELIABLY CLEANING IMAGE BEARING MEMBER

CROSS REFERENCE TO RELATED APPLICATION

This application claims priority from Japanese Patent Application No. 2013-017861 filed Jan. 31, 2013. The entire content of the priority application is incorporated herein by reference.

TECHNICAL FIELD

The present invention relates to an image forming apparatus using an electrophotographic method.

BACKGROUND

There is known, as the image forming apparatus using an electrophotographic method, a printer provided with a photosensitive member carrying a developer image thereon and a transfer member for transferring the developer image formed on the photosensitive member onto a sheet.

For example, there is proposed a printer provided with a photosensitive member carrying a toner image thereon and a transfer roller for transferring the toner image formed on a surface of the photosensitive member to a recording sheet.

In this printer, transfer bias is made to increase in accordance with an increase in a resistance value of the transfer roller due to an increase in the number of recorded sheets. This configuration can maintain an electric field between the photosensitive member and the transfer roller, thereby preventing degradation in transfer efficiency.

SUMMARY

However, in the printer described above, a surface potential of the photosensitive member may be excessively lowered when the transfer bias is increased.

When the surface potential of the photosensitive member is excessively lowered during a recording operation, toner collected by an electrically-conductive brush roller may be expelled onto the surface of the photosensitive member, which causes degradation of image quality.

In view of the foregoing, it is an object of the present invention to provide an image forming apparatus capable of reliably cleaning an image bearing member by means of a cleaning member.

In order to attain the above and other objects, the present invention provides an image forming apparatus including: an image forming unit; and a controller. The image forming unit includes: an image bearing member; a charging member; a transfer member; and a cleaning member. The image bearing member has a surface and is configured to carry a developer image on the surface. The charging member is configured to apply an electric charge to the surface of the image bearing member. The transfer member is configured to transfer the developer image carried on the surface of the image bearing member to a transfer medium. The cleaning member is configured to remove residual developer that remains on the surface of the image bearing member after the developer image has been transferred onto the transfer medium from the surface of the image bearing member. The controller is configured to selectively apply a plurality of transfer biases including a first transfer bias and a second transfer bias to the transfer member. The first transfer current flows between the image bearing member and the transfer member when the first transfer bias is applied to the transfer member. The second transfer current larger than the first transfer current flows between the image bearing member and the transfer member when the second transfer bias is applied to the transfer member. The controller is further configured to selectively apply a plurality of charging biases including a first charging bias and a second charging bias to the charging member. The image bearing member has a first surface potential when the first charging bias is applied to the charging member. The image bearing member has a second surface potential larger than the first surface potential when the second charging bias is applied to the charging member. The controller applies the first charging bias to the charging member when applying the first transfer bias to the transfer member, and applies the second charging bias to the charging member when applying the second transfer bias to the transfer member.

According to another aspect, the present invention provides an image forming apparatus including: an image forming unit; and a controller. The image forming unit includes: an image bearing member; a charging member; and a transfer member. The image bearing member has a surface and is configured to carry a developer image on the surface. The charging member is configured to apply an electric charge to the surface of the image bearing member. The transfer member is configured to transfer the developer image carried on the surface of the image bearing member to a transfer medium. The controller is configured to selectively apply a plurality of transfer biases including a first transfer bias and a second transfer bias to the transfer member. The second transfer bias is larger than the first transfer bias. The controller is further configured to selectively apply a plurality of charging biases including a first charging bias and a second charging bias to the charging member. The image bearing member has a first surface potential when the first charging bias is applied to the charging member. The image bearing member has a second surface potential higher than the first surface potential when the second charging bias is applied to the charging member. The controller applies the first charging bias to the charging member when applying the first transfer bias to the transfer member, and applies the second charging bias to the charging member when applying the second transfer bias to the transfer member.

DETAILED DESCRIPTION

1. Overall Structure of Printer

A printer as an image forming apparatus according to a first embodiment of the present invention will be described with reference to FIGS. 1 and 2.

Figure 1:
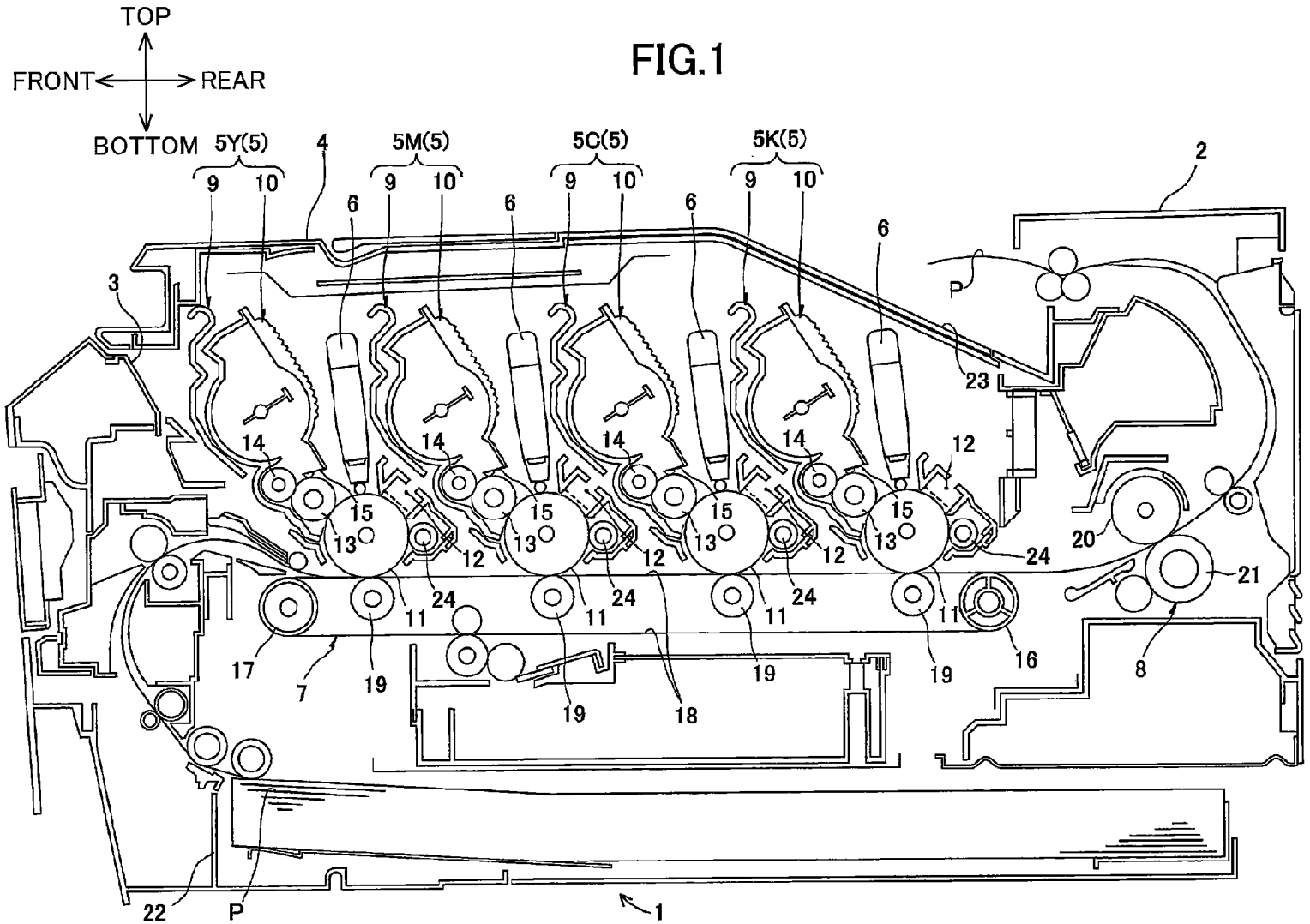
FIG. 1 is a cross-sectional view illustrating a printer according to a first embodiment of the present invention.

As illustrated in FIG. 1, the printer 1 is a horizontal direct tandem-type color printer.

Throughout the specification, the terms "upward", "downward", "upper", "lower", "above", "below", "beneath", "right", "left", "front", "rear" and the like will be used assuming that the printer 1 is disposed in an orientation in which it is intended to be used. That is, directions related to the printer 1 will be given based on the state of the printer 1 when the printer 1 is resting on a level surface. More specifically, in FIG. 1 a left side and a right side are a front side and a rear side, respectively. Further, a left side and a right side of the printer 1 will be based on the perspective of a user facing the front of the printer 1. Hence, in FIG. 1 a near side and a far side are a right side and a left side, respectively. Further, in FIG. 1 a top side and a bottom side are a top side and a bottom side, respectively.

The printer 1 includes a main casing 2 having substantially a box-like shape. The main casing 2 is formed with an opening 3 at a top portion thereof. A top cover 4 opening and closing the opening 3 is provided at the top portion of the main casing 2 so as to be pivotally movable about its rear end portion. The printer 1 further includes a plurality of process units 5 (four in the embodiment), a plurality of LED units 6 (four in the embodiment), a transfer unit 7, and a fixing unit 8.

All the process units 5 are detachably provided in the main casing 2. The plurality of process units 5 corresponds respectively to yellow, magenta, cyan, and black colors, and is arranged juxtaposed with and spaced apart from one another in a front-rear direction. Specifically, from a front side to a rear side of the main casing 2, a yellow process unit 5Y, a magenta process unit 5M, a cyan process unit 5C, and a black process unit 5K are arranged in this order.

The process unit 5 includes a drum unit 9 and a developing unit 10 detachably mounted in the drum unit 9.

The drum unit 9 includes a photosensitive drum 11, a scorotron charger 12, and a drum cleaning roller 24.

The photosensitive drum 11 is formed in substantially a cylindrical shape that is elongated in a left-right direction and rotatably provided at a rear end portion of the drum unit 9.

Incidentally, the photosensitive drum 11 provided in the black process unit 5K is an example of a first image bearing member. The photosensitive drums 11 provided in the yellow process unit 5Y, the magenta process unit 5M, and the cyan process unit 5C, respectively, are an example of a second image bearing member.

Hereinafter, the photosensitive drum 11 provided in the yellow process unit 5Y will be referred to as the yellow photosensitive drum 11; the photosensitive drum 11 provided in the magenta process unit 5M will be referred to as the magenta photosensitive drum 11; the photosensitive drum 11 provided in the cyan process unit 5C will be referred to as the cyan photosensitive drum 11; and the photosensitive drum 11 provided in the black process unit 5K will be referred to as the black photosensitive drum 11.

The scorotron charger 12 is disposed opposite to and spaced apart from the photosensitive drum 11 at an upper-rear side thereof.

Hereinafter, the scorotron charger 12 provided in the yellow process unit 5Y will be referred to as the yellow scorotron charger 12; the scorotron charger 12 provided in the magenta process unit 5M will be referred to as the magenta scorotron charger 12; the scorotron charger 12 provided in the cyan process unit 5C will be referred to as the cyan scorotron charger 12; and the scorotron charger 12 provided in the black process unit 5K will be referred to as the black scorotron charger 12.

The drum cleaning roller 24 is disposed below the scorotron charger 12 at a rear side of the photosensitive drum 11. The drum cleaning roller 24 contacts the photosensitive drum 11 from the rear side thereof. The drum cleaning roller 24 is formed in substantially a cylindrical shape that is elongated in the left-right direction.

Hereinafter, the drum cleaning roller 24 provided in the yellow process unit 5Y will be referred to as the yellow drum cleaning roller 24; the drum cleaning roller 24 provided in the magenta process unit 5M will be referred to as the magenta drum cleaning roller 24; and the drum cleaning roller 24 provided in the cyan process unit 5C will be referred to as the cyan drum cleaning roller 24; and the drum cleaning roller 24 provided in the black process unit 5K will be referred to as the black drum cleaning roller 24.

The developing unit 10 includes a developing roller 13 and a supply roller 14 for supplying toner to the developing roller 13.

The developing roller 13 is rotatably supported at a rear end portion of the developing unit 10 so as to be exposed in a rear side of the developing unit 10. The developing roller 13 contacts the corresponding photosensitive drum 11 from an upper-front side thereof. The developing roller 13 is formed in substantially a cylindrical shape that is elongated in the left-right direction.

The supply roller 14 is rotatably supported to the developing unit 10 and disposed at an upper-front side of the developing roller 13 so as to contact the developing roller 13. The supply roller 14 is formed in substantially a cylindrical shape that is elongated in the left-right direction.

The developing unit 10 further includes a layer thickness regulating blade 15 for regulating a thickness of toner supplied to the developing roller 13. Further, the developing unit 10 accommodates toner (developer) therein above the developing roller 13 and the supply roller 14.

Each of the plurality of LED units 6 is supported at the top cover 4 so as to be opposed to an upper portion of the corresponding photosensitive drum 11 of each of the plurality of process units 5.

The transfer unit 7 is disposed below and opposite to the plurality of process units 5. The transfer unit 7 includes a driving roller 16, a driven roller 17, a conveyor belt 18, and a plurality of transfer rollers 19.

The driving roller 16 is rotatably supported at a rear end portion of the transfer unit 7.

The driven roller 17 is rotatably supported at a front end portion of the transfer unit 7.

The conveyor belt 18 is looped around the driving roller 16 and the driven roller 17 in such a manner that an upper portion of the conveyor belt 18 contacts all the photosensitive drums 11 from below. When the driving roller 16 is driven to rotate, the conveyor belt 18 circulates so that its upper portion moves rearward, and the driven roller 17 rotates along with the circulating movement of the conveyor belt 18.

Each of the plurality of transfer rollers 19 is disposed below and opposite to the corresponding photosensitive drum 11, with the upper portion of the conveyor belt 18 interposed between the top of the transfer roller 19 and the bottom of the corresponding photosensitive drum 11.

The transfer roller 19 corresponding to the yellow photosensitive drum 11 will be referred to as the yellow transfer roller 19; the transfer roller 19 corresponding to the magenta photosensitive drum 11 will be referred to as the magenta transfer roller 19; the transfer roller 19 corresponding to the cyan photosensitive drum 11 will be referred to as the cyan transfer roller 19; and the transfer roller 19 corresponding to the black photosensitive drum 11 will be referred to as the black transfer roller 19.

The fixing unit 8 is disposed rearward of the transfer unit 7 so as to be opposed thereto. The fixing unit 8 includes a heating roller 20 and a pressure roller 21 opposite to the heating roller 20.

When a print job is inputted to the printer 1 from an external personal computer 51 (see FIG. 2), an image forming operation is started. Then, the toner accommodated in each developing unit 10 is conveyed between the supply roller 14 and the corresponding developing roller 13 to be positively tribo-charged between the supply roller 14 and the corresponding developing roller 13. The layer thickness regulating blade 15 regulates the thickness of toner supplied to the corresponding developing roller 13, maintaining the toner carried on the surface of the corresponding developing roller 13 at a thin uniform thickness.

In the meantime, each scorotron charger 12 applies a uniform charge to a surface of the corresponding photosensitive drum 11. Subsequently, the photosensitive drum 11 is exposed to light by the corresponding LED unit 6 based on predetermined image data, forming an electrostatic latent image on the surface of the photosensitive drum 11 based on the image data. The toner carried on the developing roller 13 is then supplied to the electrostatic latent image formed on the surface of the corresponding photosensitive drum 11. In this way, a toner image (developer image) is carried on the surface of the photosensitive drum 11.

The main casing 2 is provided with a sheet supply tray 22 at a bottom portion thereof. Each sheet P (transfer medium) accommodated in the sheet supply tray 22 is conveyed upward and rearward by various rollers while passing through a U-shaped path, and conveyed to a position between the photosensitive drum 11 and the conveyor belt 18 at a prescribed timing. Subsequently, the sheet P is conveyed by the conveyor belt 18 to pass between each photosensitive drum 11 and the corresponding transfer roller 19 from front to rear. At this time, toner images are transferred onto the sheet P by transfer bias applied to the transfer rollers 19.

Next, the sheet P is subjected to heat and pressure while passing between the heating roller 20 and the pressure roller 21 of the fixing unit 8, thereby thermally fixing the toner images to the sheet P.

Thereafter, the sheet P is conveyed upward and frontward along a U-shaped path to be discharged to a discharge tray 23 provided on the top cover 4.

2. Detailed Description of Process Unit (1) Photosensitive Drum

Figure 2:
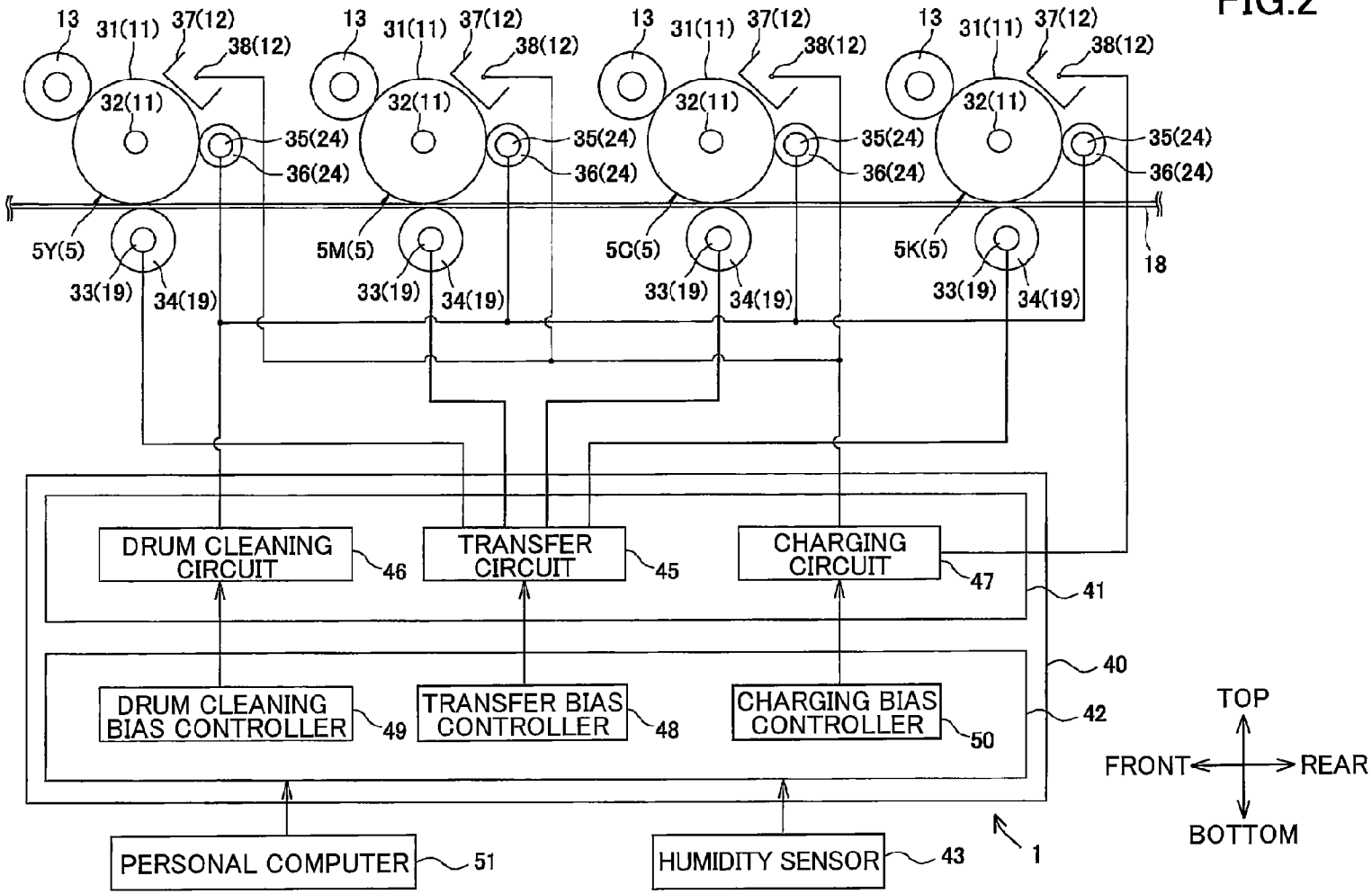
FIG. 2 is a block diagram illustrating essential components of an electrical structure of the printer of FIG. 1.

As illustrated in FIG. 2, each photosensitive drum 11 includes a drum body 31 and a shaft 32.

The drum body 31 is made of metal and is formed in substantially a cylindrical shape that is elongated in the left-right direction. A photosensitive layer is formed on a peripheral surface of the drum body 31. While not shown in FIG. 2, flange members are provided one on each of left and right end portions of the drum body 31. Each flange member is non-rotatably fitted to the left-right end portion of the drum body 31.

The shaft 32 is made of metal and is formed in substantially a cylindrical shape that extends along an axis of the drum body 31. The shaft 32 is non-rotatably supported to the flange members so as to penetrate a center in a radial direction of each of the flange members. Further, the shaft 32 is electrically connected to an inner surface of the drum body 31 through an electrically-conductive metal member (not illustrated). The shaft 32 is grounded to the main casing 2.

(2) Scorotron Charger

Each scorotron charger 12 includes a grid 37 and a charging wire 38.

The grid 37 is made of metal and is formed in a frame-like shape that is substantially U-shaped in cross-section with an opening at an upper-rear side thereof and that extends in the left-right direction.

The charging wire 38 is made of metal and is substantially linearly formed. The charging wire 38 is stretched in the left-right direction in the grid 37.

(3) Transfer Roller

Each transfer roller 19 includes a transfer roller shaft 33 and a transfer roller body 34.

The transfer roller shaft 33 is made of metal and is formed in substantially a cylindrical shape that extends in the left-right direction.

The transfer roller body 34 is made of a resin material having electrically-conductive properties and is formed in substantially a cylindrical shape that is elongated in the left-right direction. The transfer roller body 34 covers the transfer roller shaft 33 so as to expose left and right end portions of the transfer roller shaft 33 to the outside.

(4) Drum Cleaning Roller

Each drum cleaning roller 24 includes a drum cleaning roller shaft 35 and a drum cleaning roller body 36.

The drum cleaning roller shaft 35 is made of metal and is formed in substantially a cylindrical shape that extends in the left-right direction.

The drum cleaning roller body 36 is made of a foamed silicon resin or a formed urethane resin, having semi-electrically-conductive properties. The drum cleaning roller body 36 is formed in substantially a cylindrical shape that is elongated in the left-right direction and covers the drum cleaning roller shaft 35 so as to expose left and right end portions of the drum cleaning roller shaft 35 to the outside.

3. Electrical Structure of Printer

The printer 1 includes, within the main casing 2, a controller 40 and a humidity sensor 43.

The controller 40 includes a power supply substrate 41 and a control substrate 42.

The power supply substrate 41 includes a transfer circuit 45 for supplying electric power to the transfer rollers 19, a drum cleaning circuit 46 for supplying electric power to the drum cleaning rollers 24, and a charging circuit 47 for supplying electric power to the scorotron chargers 12.

The transfer circuit 45 is electrically connected to the transfer roller shaft 33 of each of the plurality of transfer rollers 19 through a wiring. The transfer circuit 45 applies transfer bias individually to the plurality of transfer rollers 19 under control of the control substrate 42.

The drum cleaning circuit 46 is electrically connected to the drum cleaning roller shaft 35 of each of the plurality of drum cleaning rollers 24 through a wiring. The drum cleaning circuit 46 applies the same drum cleaning bias to all the drum cleaning rollers 24 under control of the control substrate 42.

The charging circuit 47 is electrically connected to the charging wire 38 of each of the plurality of scorotron chargers 12 through a wiring. Under control of the control substrate 42, the charging circuit 47 applies the same charging bias collectively to the yellow, magenta, and cyan scorotron chargers 12 and applies charging bias independently to the black scorotron charger 12.

The control substrate 42 includes a CPU and a memory. The control substrate 42 includes, as configurations to be realized in a software manner by program processing under control of the CPU, a transfer bias controller 48 for controlling the transfer circuit 45, a drum cleaning bias controller 49 for controlling the drum cleaning circuit 46, and a charging bias controller 50 for controlling the charging circuit 47.

The humidity sensor 43 is a sensor for measuring a relative humidity inside the main casing 2 and is electrically connected to the control substrate 42 through a signal wiring.

4. Image Forming Operation (1) Setting of Transfer Current, Charging Bias, and Drum Cleaning Bias When the above-described image forming operation is performed, the charging bias controller 50 sets the charging bias, the transfer bias controller 48 sets the transfer current, and the drum cleaning bias controller 49 sets the drum cleaning bias.

(1-1) Normal Humidity Environment

First, settings of the charging bias, the transfer current, and the drum cleaning bias when the main casing 2 is in a normal humidity environment will be described. Note that, when the main casing 2 is in the normal humidity environment, the relative humidity inside the main casing 2 measured by the humidity sensor 43 is higher than 30% and lower than 60%.

When the main casing 2 is in the normal humidity environment, the charging bias controller 50 sets the charging bias to be applied to all the scorotron chargers 12 to, for example, +700 V. This charging bias is an example of a first charging bias.

The transfer bias controller 48 sets the transfer current to be made to flow between the yellow photosensitive drum 11 and the yellow transfer roller 19 to, for example, −8 μA. This transfer current is an example of a first transfer current in the yellow transfer roller 19.

The transfer bias controller 48 also sets the transfer current to be made to flow between the magenta photosensitive drum 11 and the magenta transfer roller 19 to, for example, −9 μA. This transfer current is an example of a first transfer current in the magenta transfer roller 19.

The transfer bias controller 48 also sets the transfer current to be made to flow between the cyan photosensitive drum 11 and the cyan transfer roller 19 to, for example, −9 μA. This transfer current is an example of a first transfer current in the cyan transfer roller 19.

The transfer bias controller 48 also sets the transfer current to be made to flow between the black photosensitive drum 11 and the black transfer roller 19 to, for example, −9 μA. This transfer current is an example of a first transfer current in the black transfer roller 19.

The drum cleaning bias controller 49 sets the drum cleaning bias to be applied to all the drum cleaning rollers 24 to, for example, −300 V.

(1-2) Low Humidity Environment

Next, settings of the charging bias, the transfer current, and the drum cleaning bias when the main casing 2 is in a low humidity environment will be described. Note that, when the main casing 2 is in the low humidity environment, the relative humidity inside the main casing 2 measured by the humidity sensor 43 is equal to or lower than 30%.

When the main casing 2 is in the low humidity environment, the charging bias controller 50 sets the charging bias to be applied to the yellow, magenta, and cyan scorotron chargers 12 to, for example, +750 V. This charging bias is an example of a second charging bias.

Further, the charging bias controller 50 sets the charging bias to be applied to the black scorotron charger 12 to, for example, +800 V. This charging bias is an example of a third charging bias.

The transfer bias controller 48 sets the transfer current to be made to flow between the yellow photosensitive drum 11 and the yellow transfer roller 19 to, for example, −9 μA. This transfer current is an example of a second transfer current in the yellow transfer roller 19.

The transfer bias controller 48 also sets the transfer current to be made to flow between the magenta photosensitive drum 11 and the magenta transfer roller 19 to, for example, −10 μA. This transfer current is an example of a second transfer current in the magenta transfer roller 19.

The transfer bias controller 48 also sets the transfer current to be made to flow between the cyan photosensitive drum 11 and the cyan transfer roller 19 to, for example, −10 μA. This transfer current is an example of a second transfer current in the cyan transfer roller 19.

The transfer bias controller 48 also sets the transfer current to be made to flow between the black photosensitive drum 11 and the black transfer roller 19 to, for example, −11 μA. This transfer current is an example of a second transfer current in the black transfer roller 19.

The drum cleaning bias controller 49 sets the drum cleaning bias to be applied to all the drum cleaning rollers 24 to, for example, −300 V.

(2) Transfer and Cleaning Operations (2-1) Transfer and Cleaning Operations in Normal Humidity Environment When the main casing 2 is in the normal humidity environment at the time of execution of the above-described image forming operation, the charging bias controller 50 controls the charging circuit 47 to apply the above charging bias to the charging wires 38 of all the scorotron chargers 12.

Then, surfaces of all the photosensitive drums 11 are each charged at a charging potential of, for example, +700 V in a state before being exposed by the corresponding LED units 6. This charging potential is a first surface potential.

The transfer bias controller 48 controls the transfer circuit 45 to apply the transfer bias to the respective transfer rollers 19 so as to make the transfer current constantly flow between the transfer rollers 19 and their corresponding photosensitive drums 11.

Specifically, the transfer bias controller 48 applies a transfer bias of, for example, −1200 V to the yellow transfer roller 19. This transfer bias is an example of a first transfer bias in the yellow transfer roller 19.

The transfer bias controller 48 also applies a transfer bias of, for example, −1350 V to the magenta transfer roller 19. This transfer bias is an example of a first transfer bias in the magenta transfer roller 19.

The transfer bias controller 48 also applies a transfer bias of, for example, −1350 V to the cyan transfer roller 19. This transfer bias is an example of a first transfer bias in the cyan transfer roller 19.

The transfer bias controller 48 also applies a transfer bias of, for example, −1350 V to the black transfer roller 19. This transfer bias is an example of a first transfer bias in the black transfer roller 19.

The drum cleaning bias controller 49 controls the drum cleaning circuit 46 to apply the above-described drum cleaning bias to all the drum cleaning rollers 24.

Then, while the sheet P is passing through positions where the photosensitive drums 11 oppose to their corresponding transfer rollers 19, the toner image carried on each photosensitive drum 11 is transferred onto the sheet P.

At this time, the transfer current flows from the yellow transfer roller 19 to the yellow photosensitive drum 11, with the result that the surface potential of the yellow photosensitive drum 11 is lowered from +700 V to about +300 V.

Further, the transfer current flows from the magenta transfer roller 19 to the magenta photosensitive drum 11, with the result that the surface potential of the magenta photosensitive drum 11 is lowered from +700 V to about +250 V.

Further, the transfer current flows from the cyan transfer roller 19 to the cyan photosensitive drum 11, with the result that the surface potential of the cyan photosensitive drum 11 is lowered from +700 V to about +250 V.

Further, the transfer current flows from the black transfer roller 19 to the black photosensitive drum 11, with the result that the surface potential of the black photosensitive drum 11 is lowered from +700 V to about +250 V.

Thereafter, in each of the plurality of photosensitive drums 11, residual toner that has not been transferred onto the sheet P and remains on the peripheral surface of the photosensitive drum 11 is opposed to the corresponding drum cleaning roller 24 in association with rotation of the photosensitive drum 11 and is then electrostatically held on a peripheral surface of the corresponding drum cleaning roller 24 by the drum cleaning bias.

(2-2) Transfer and Cleaning Operations in Low Humidity Environment

When the main casing 2 is in the low humidity environment at the time of execution of the above-described image forming operation, the charging bias controller 50 controls the charging circuit 47 to apply the above charging bias to the charging wires 38 of each of the plurality of scorotron chargers 12.

Then, the surfaces of the yellow, magenta, and cyan photosensitive drums 11 are each charged at a charging potential of, for example, +750 V in a state before being exposed by the corresponding LED units 6. This charging potential is a second surface potential.

The surface of the black photosensitive drum 11 is charged at a charging potential of, for example, +800 V in a state before being exposed by the corresponding LED unit 6. This charging potential is a third surface potential.

The transfer bias controller 48 controls the transfer circuit 45 to apply the transfer bias to the respective transfer rollers 19 so as to make the transfer current constantly flow between the transfer rollers 19 and their corresponding photosensitive drums 11.

Specifically, the transfer bias controller 48 applies a transfer bias of, for example, −2250 V to the yellow transfer roller 19. This transfer bias is an example of a second transfer bias in the yellow transfer roller 19.

The transfer bias controller 48 applies a transfer bias of, for example, −2500 V to the magenta transfer roller 19. This transfer bias is an example of a second transfer bias in the magenta transfer roller 19.

The transfer bias controller 48 also applies a transfer bias of, for example, −2500 V to the cyan transfer roller 19. This transfer bias is an example of a second transfer bias in the cyan transfer roller 19.

The transfer bias controller 48 also applies a transfer bias of, for example, −2750 V to the black transfer roller 19. This transfer bias is an example of a second transfer bias in the black transfer roller 19.

The drum cleaning bias controller 49 controls the drum cleaning circuit 46 to apply the above-described drum cleaning bias to all the drum cleaning rollers 24.

Then, while the sheet P is passing through positions where the photosensitive drums 11 oppose to their corresponding transfer rollers 19, the toner image carried on each photosensitive drum 11 is transferred onto the sheet P.

At this time, the transfer current flows from the yellow transfer roller 19 to the yellow photosensitive drum 11, with the result that the surface potential of the yellow photosensitive drum 11 is lowered from +750 V to about +300 V.

Further, the transfer current flows from the magenta transfer roller 19 to the magenta photosensitive drum 11, with the result that the surface potential of the magenta photosensitive drum 11 is lowered from +750 V to about +250 V.

Further, the transfer current flows from the cyan transfer roller 19 to the cyan photosensitive drum 11, with the result that the surface potential of the cyan photosensitive drum 11 is lowered from +750 V to about +250 V.

Further, the transfer current flows from the black transfer roller 19 to the black photosensitive drum 11, with the result that the surface potential of the black photosensitive drum 11 is lowered from +800 V to about +250 V.

Thereafter, in each of the plurality of photosensitive drums 11, residual toner that has not been transferred onto the sheet P and remains on the peripheral surface of the photosensitive drum 11 is electrostatically held on the peripheral surface of the corresponding drum cleaning roller 24 as in the case where the main casing 2 is in the normal humidity environment.

4. Operational Advantages (1) According to the printer 1, the setting values of both the transfer current and the charging bias are made to increase when the relative humidity inside the main casing 2 measured by the humidity sensor 43 is equal to or lower than 30%.

Specifically, the transfer current to be made to flow between the yellow photosensitive drum 11 and the yellow transfer roller 19 is changed from −8 μA to −9 μA, and the charging bias to be applied to the charging wire 38 of the yellow scorotron charger 12 is changed from +700 V to +750 V.

The transfer current to be made to flow between the magenta photosensitive drum 11 and the magenta transfer roller 19 is changed from −9 μA to −10 μA, and the charging bias to be applied to the charging wire 38 of the magenta scorotron charger 12 is changed from +700 V to +750 V.

The transfer current to be made to flow between the cyan photosensitive drum 11 and the cyan transfer roller 19 is changed from −9 μA to −10 μA, and the charging bias to be applied to the charging wire 38 of the cyan scorotron charger 12 is changed from +700 V to +750 V.

The transfer current to be made to flow between the black photosensitive drum 11 and the black transfer roller 19 is changed from −9 μA to −11 μA, and the charging bias to be applied to the charging wire 38 of the black scorotron charger 12 is changed from +700 V to +800 V.

As a result, when larger transfer current flows between the photosensitive drum 11 and the corresponding transfer roller 19, the surface potential of the photosensitive drum 11 is made larger.

Thus, when the relative humidity inside the main casing 2 measured by the humidity sensor 43 is equal to or lower than 30%, that is, when electric resistance of the sheet P is expected to increase, the surface potential of each photosensitive drum 11 can be prevented from being excessively lowered due to an increase in the value of the transfer current while the toner image can reliably be transferred onto the sheet P, thereby preventing the residual toner collected by each drum cleaning roller 24 from being adhered once again onto the corresponding photosensitive drum 11.

As a result, each photosensitive drum 11 can reliably be cleaned by the corresponding drum cleaning roller 24.

(2) Further, according to the printer 1, when the relative humidity inside the main casing 2 measured by the humidity sensor 43 is equal to or lower than 30%, the charging bias applied to the black scorotron charger 12 provided in the black process unit 5K which is the most downstream side process unit in a conveying direction of the sheet P, i.e., the rearmost process unit, is set larger than the charging bias applied to the scorotron chargers 12 of the process units 5 disposed frontward of the black process unit 5K.

As a result, the surface potential of the black photosensitive drum 11 can be prevented from being excessively lowered in the rearmost black process unit 5K having larger transfer current.

Thus, the residual toner collected by the black drum cleaning roller 24 can be prevented from being adhered once again onto the black photosensitive drum 11.

As a result, the black photosensitive drum 11 can reliably be cleaned by the black drum cleaning roller 24.

5. Second Embodiment

A printer 101 as an image forming apparatus according to a second embodiment of the present invention will be described while referring to FIG. 3, wherein like parts and components are designated with the same reference numerals to avoid duplicating description. In the following description, only parts differing from those of the embodiment will be described in detail.

(1) Overview of Second Embodiment

In the first embodiment described above, the relative humidity inside the main casing 2 is detected using the humidity sensor 43, and the setting values of both the transfer current and the charging bias are made to increase based on the detected relative humidity.

On the other hand, in the second embodiment, electric resistance between the transfer roller 19 and the corresponding photosensitive drum 11 is measured, and the setting values of both the transfer current and the charging bias are made to increase based on the measured electric resistance.

Further, in the first embodiment described above, the charging circuit 47 applies the same charging bias collectively to the yellow, magenta, and cyan scorotron chargers 12 and applies the charging bias independently to the black scorotron charger 12.

Figure 3:
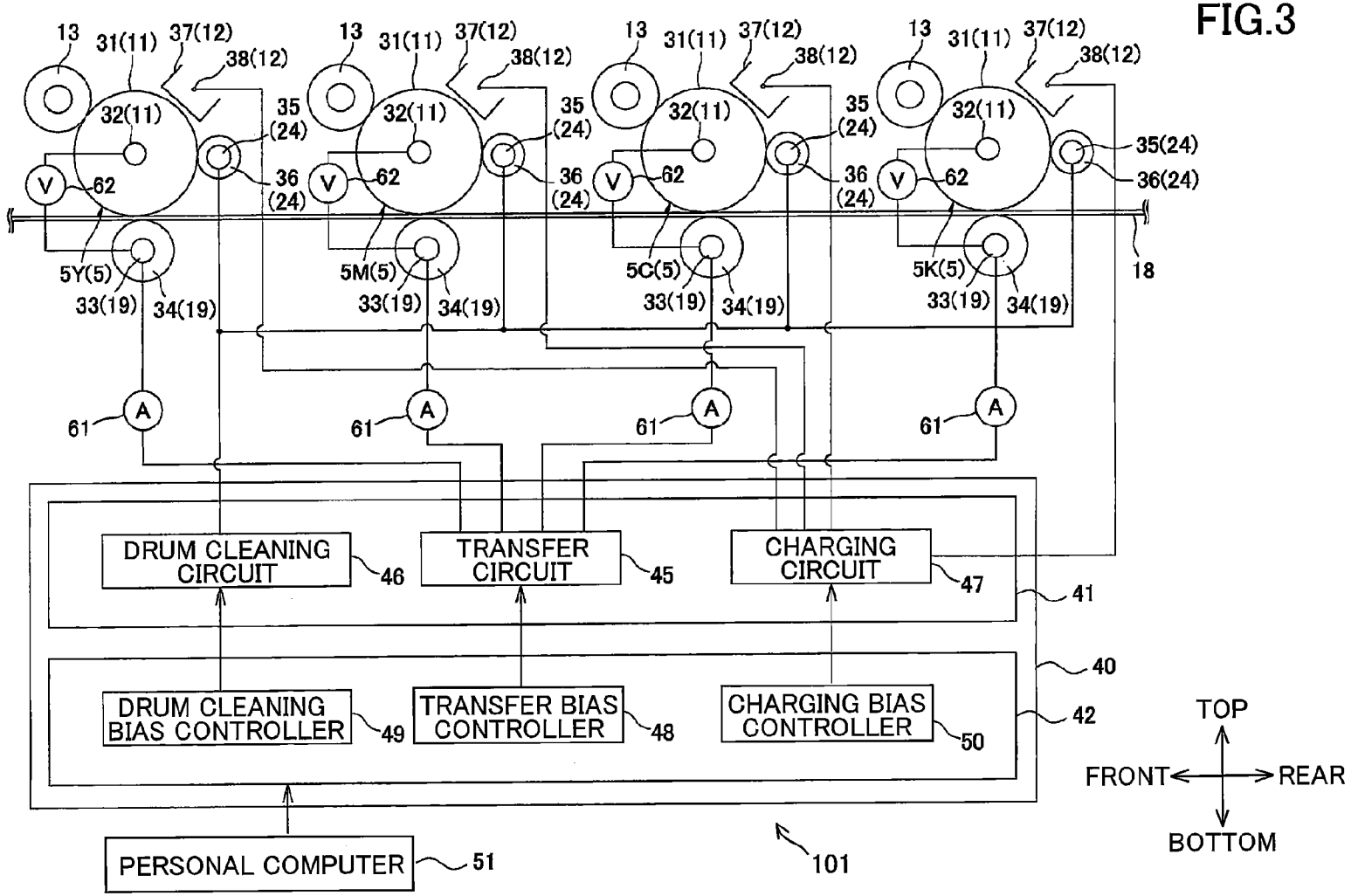
FIG. 3 is a block diagram illustrating essential components of an electrical structure of a printer according to a second embodiment of the present invention.

On the other hand, in the second embodiment, the charging circuit 47 applies the charging bias individually to the plurality of scorotron chargers 12, as illustrated in FIG. 3.

(2) Structure of Second Embodiment

In the second embodiment, the printer 101 includes a plurality of ammeters 61 and a plurality of voltmeters 62, as illustrated in FIG. 3.

Each ammeter 61 is interposed between the transfer circuit 45 and the transfer roller shaft 33 of the transfer roller 19. The ammeter 61 measures a value of current flowing from the transfer circuit 45 to the transfer roller shaft 33. Further, the ammeter 61 is electrically connected to the control substrate 42 through a signal wiring (not illustrated). The ammeter 61 transmits the measured current value to the control substrate 42.

Each voltmeter 62 is electrically connected to the transfer roller shaft 33 of the transfer roller 19 and the shaft 32 of the corresponding photosensitive drum 11. The voltmeter 62 measures voltage developed between the transfer roller shaft 33 and the shaft 32. The voltmeter 62 is electrically connected also to the control substrate 42 through a signal wiring (not illustrated). The voltmeter 62 transmits the measured voltage to the control substrate 42.

The control substrate 42 calculates an electric resistance value between each transfer roller 19 and its corresponding photosensitive drum 11 based on the current value measured by its corresponding ammeter 61 and the voltage value measured by its corresponding voltmeter 62. That is, the ammeter 61 and the voltmeter 62 constitute a resistance detector.

(3) Setting of Transfer Current and Charging Bias

In the second embodiment, when the electric resistance of the sheet P is equal to or higher than, for example, 500 MΩ, the charging bias controller 50 sets the charging bias to be applied to the scorotron charger 12 to be the same value as in the case of the low humidity environment described in the first embodiment.

Further, the transfer bias controller 48 sets the transfer current to be made to flow between the photosensitive drum 11 and its corresponding transfer roller 19 to be the same value as in the case of the low humidity environment described in the first embodiment.

Incidentally, a method of measuring the electric resistance of the sheet P is not especially limited. For example, current may be made to flow when the sheet P enters into a position between the photosensitive drum 11 and the corresponding transfer roller 19 to measure the electric resistance of the sheet P.

When the electric resistance between the transfer roller 19 and its corresponding photosensitive drum 11 is less than 500 MΩ, the charging bias controller 50 sets the charging bias to be applied to the scorotron charger 12 to be the same value as in the case of the normal humidity environment described in the first embodiment.

Similarly, the transfer bias controller 48 sets the transfer current to be made to flow between the photosensitive drum 11 and its corresponding transfer roller 19 to be the same value as in the case of the normal humidity environment described in the first embodiment.

That is, in the second embodiment, the charging bias to be applied to each of the scorotron chargers 12 is individually set, based on the electric resistance detected by the corresponding ammeter 61 and voltmeter 62, so as to be either the same value as in the case of the low humidity environment or the same value as in the case of the normal humidity environment. Hence, the charging bias to be applied to one of the scorotron chargers 12 may have the same value as in the case of the low humidity environment, while the charging bias to be applied to the remainder may have the same value as in the case of the normal humidity environment.

Similarly, the transfer current to be made to flow between each of the photosensitive drums 11 and its corresponding transfer roller 19 is also individually set, based on the electric resistance detected by the corresponding ammeter 61 and voltmeter 62, so as to be either the same value as in the case of the low humidity environment or the same value as in the case of the normal humidity environment. Hence, the transfer current to be made to flow between one of the photosensitive drums 11 and its corresponding transfer roller 19 may have the same value as in the case of the low humidity environment, while the transfer current to be made to flow between each of the remaining photosensitive drums 11 and its corresponding transfer roller 19 may have the same value as in the case of the normal humidity environment.

(4) Operational Advantages of Second Embodiment (4-1) According to the second embodiment, when an actual measurement value of the electric resistance of the sheet P (electric resistance between the transfer roller 19 and its corresponding photosensitive drum 11) is high, the setting values of both the transfer current and the charging bias are made to increase.

As a result, when the actual electric resistance of the sheet P is high, the surface potential of each photosensitive drum 11 can be prevented from being excessively lowered due to an increase in the value of the transfer current, thereby preventing the residual toner collected by each drum cleaning roller 24 from being adhered once again onto the corresponding photosensitive drum 11.

As a result, each photosensitive drum 11 can reliably be cleaned by the corresponding drum cleaning roller 24.

(4-2) Besides, the printer 101 according to the second embodiment can obtain the same operational advantages described for the printer 1 according to the first embodiment.

(5) Variation of Second Embodiment

Incidentally, only one of the process units 5 and its corresponding transfer roller 19 may be provided with a set of the ammeter 61 and the voltmeter 62, and the remaining three sets of the ammeters 61 and the voltmeter 62 may be dispensed with. For example, the ammeter 61 may only be interposed between the transfer circuit 45 and the transfer roller shaft 33 of the yellow transfer roller 19, and the voltmeter 62 may only be electrically connected to the transfer roller shaft 33 of the yellow transfer roller 19 and the shaft 32 of the yellow photosensitive drum 11.

In this case, if the electric resistance of the sheet P between the yellow transfer roller 19 and the yellow photosensitive drum 11 is equal to or higher than, for example, 500 MΩ, the charging bias controller 50 sets the charging bias to be applied to each of the scorotron chargers 12 collectively to be the same value as in the case of the low humidity environment. Similarly, the transfer bias controller 48 sets the transfer current to be made to flow between each of the photosensitive drums 11 and its corresponding transfer roller 19 collectively to be the same value as in the case of the low humidity environment.

On the other hand, if the electric resistance between the yellow transfer roller 19 and the yellow photosensitive drum 11 is less than 500 MΩ, the charging bias controller 50 sets the charging bias to be applied to each of the scorotron chargers 12 collectively to be the same value as in the case of the normal humidity environment. Similarly, the transfer bias controller 48 sets the transfer current to be made to flow between each of the photosensitive drums 11 and its corresponding transfer roller 19 collectively to be the same value as in the case of the normal humidity environment.

6. Third Embodiment

Figure 4:
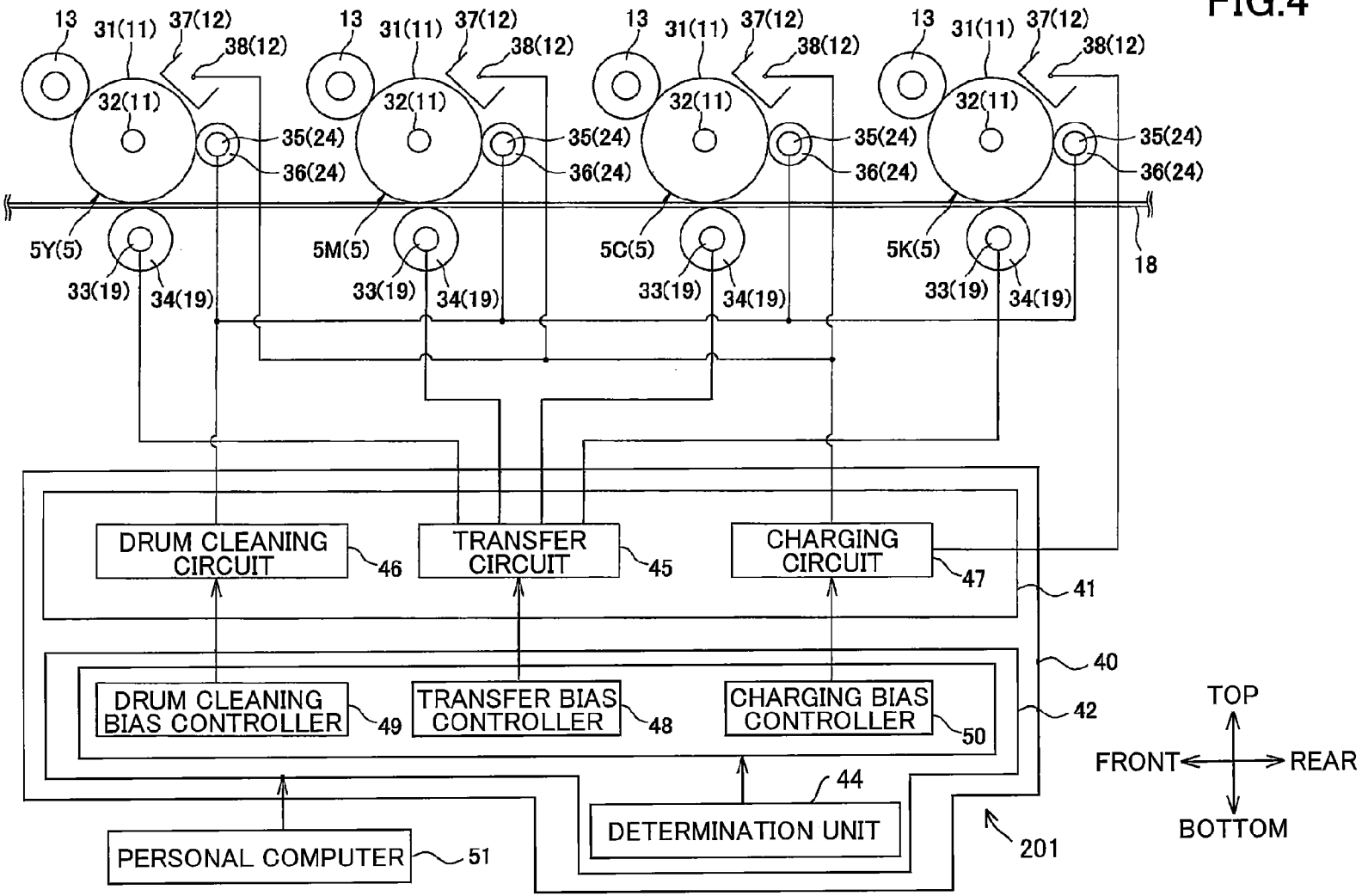
FIG. 4 is a block diagram illustrating essential components of an electrical structure of a printer according to a third embodiment of the present invention.

A printer 201 as an image forming apparatus according to a third embodiment of the present invention will be described while referring to FIG. 4, wherein like parts and components are designated with the same reference numerals to avoid duplicating description. In the following description, only parts differing from those of the embodiment will be described in detail.

(1) Overview of Third Embodiment

In the first embodiment described above, the transfer bias controller 48 increases the setting value of the transfer current and the charging bias controller 50 increases the setting value of the charging bias, when the main casing 2 is in the low humidity environment.

On the other hand, in the third embodiment, the transfer bias controller 48 increases the setting value of the transfer current and the charging bias controller 50 increases the setting value of the charging bias, when a print job is inputted to the printer 201 from the external personal computer 51, depending on a type of the sheet P specified in the print job.

(2) Setting of Transfer Current and Charging Bias

In the third embodiment, the control substrate 42 further includes a determination unit 44 for determining the type and size of the sheet P specified in the print job. When the type of the sheet P specified in the print job is determined by the determination unit 44 as, for example, a sheet whose ratio of left-right length relative to a left-right length of a maximum image formation area of the photosensitive drum 11 is equal to or less than a predetermined value, such as a postcard, or a sheet P having comparatively high electric resistance, such as a glossy paper or a heavy paper, the setting values of both the transfer current and the charging bias are made to increase.

Specifically, when the left-right length of the sheet P specified in the print job is equal to or less than, for example, 90%, preferably, 80% relative to the left-right length of the maximum image formation area of the photosensitive drum 11, the charging bias controller 50 sets the charging bias to be applied to the individual scorotron chargers 12 to be the same values as in the case of the low humidity environment described in the first embodiment.

The transfer bias controller 48 sets the transfer current to be made to flow between each of the plurality of photosensitive drums 11 and its corresponding transfer roller 19 to be the same value as in the case of the low humidity environment described in the first embodiment.

When the ratio of the left-right length of the sheet P specified in the print job relative to the left-right length of the maximum image formation area of the photosensitive drum 11 is more than, for example, 90%, the charging bias controller 50 sets the charging bias to be applied to the individual scorotron chargers 12 to be the same values as in the case of the normal humidity environment described in the first embodiment.

Similarly, the transfer bias controller 48 sets the transfer current to be made to flow between each of the plurality of photosensitive drums 11 and its corresponding transfer roller 19 to be the same value as in the case of the normal humidity environment described in the first embodiment.

(3) Operational Advantages of Third Embodiment

The printer 201 according to the third embodiment can obtain the same operational advantages described for the printer 1 according to the first embodiment.

More in detail, in the third embodiment, when a printing operation is performed for a sheet P requiring larger transfer current, such as one whose ratio of left-right length relative to the left-right length of the maximum image formation area of the photosensitive drum 11 is equal to or less than the above value or one having comparatively high electric resistance, such as a glossy paper or a heavy paper, the setting values of both the transfer current and the charging bias are made to increase.

As a result, when a printing operation is performed for a sheet P requiring larger transfer current, a toner image can reliably be transferred onto the sheet P, and the residual toner collected by each drum cleaning roller 24 can be prevented from being adhered once again onto the corresponding photosensitive drum 11.

As a result, each photosensitive drum 11 can reliably be cleaned by the corresponding drum cleaning roller 24.

7. Fourth Embodiment

A printer 301 as an image forming apparatus according to a third embodiment of the present invention will be described while referring to FIG. 5, wherein like parts and components are designated with the same reference numerals to avoid duplicating description. In the following description, only parts differing from those of the embodiment will be described in detail.

(1) Overview of Fourth Embodiment

In the first embodiment described above, the charging circuit 47 applies the same charging bias collectively to the yellow, magenta, and cyan scorotron chargers 12 and applies the charging bias independently to the black scorotron charger 12.

Figure 5:
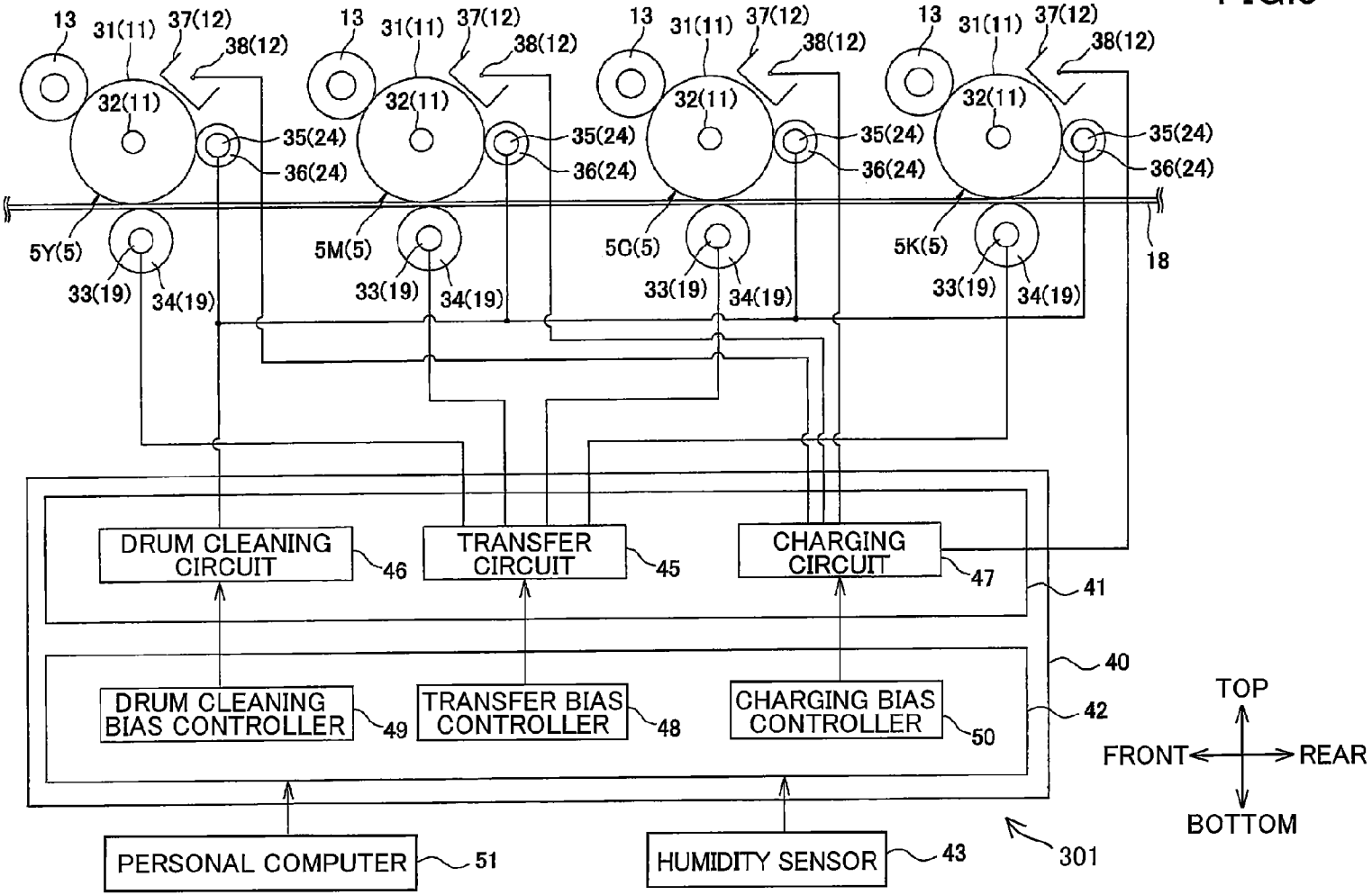
FIG. 5 is a block diagram illustrating essential components of an electrical structure of a printer according to a fourth embodiment of the present invention.

On the other hand, in the fourth embodiment, the charging circuit 47 applies the charging bias individually to the plurality of scorotron chargers 12, as illustrated in FIG. 5.

(2) Setting of Transfer Current and Charging Bias

In the fourth embodiment, when the main casing 2 is in the normal humidity environment, the charging bias controller 50 sets the charging bias to be applied to the yellow scorotron charger 12 to, for example, +650 V.

The charging bias controller 50 sets the charging bias to be applied to the magenta scorotron charger 12 to, for example, +700 V.

The charging bias controller 50 sets the charging bias to be applied to the cyan scorotron charger 12 to, for example, +700 V.

The charging bias controller 50 sets the charging bias to be applied to the black scorotron charger 12 to, for example, +700 V.

When the main casing 2 is in the low humidity environment, the charging bias controller 50 sets the charging bias to be applied to the yellow scorotron charger 12 to, for example, +700 V.

The charging bias controller 50 sets the charging bias to be applied to the magenta scorotron charger 12 to, for example, +750 V.

The charging bias controller 50 sets the charging bias to be applied to the cyan scorotron charger 12 to, for example, +750 V.

The charging bias controller 50 sets the charging bias to be applied to the black scorotron charger 12 to, for example, +800 V.

That is, the charging bias controller 50 sets the charging bias to be applied individually to the scorotron chargers 12 such that higher charging bias is applied to the scorotron chargers 12 in the order along the front-to-rear direction. That is, the charging bias to be applied to the scorotron charger 12 that is positioned further rearward is set to be higher than the charging bias to be applied to the scorotron charger 12 that is positioned further frontward.

The transfer bias controller 48 sets the transfer bias to be applied individually to the plurality of transfer rollers 19 in the same manner as in the first embodiment.

In the fourth embodiment, the front more side image forming units among the plurality of image forming units are an example of a first image forming unit, and the image forming units disposed rearward of the first image forming unit is an example of a second image forming unit.

For example, when a set of the yellow process unit 5Y and the yellow transfer roller 19 is assumed to be the first image forming unit, a set of the magenta process unit 5M and the magenta transfer roller 19, a set of the cyan process unit 5 and the cyan transfer roller 19, and a set of the black process unit 5K and the black transfer roller 19, which are disposed rearward of the set of the yellow process unit 5Y and the yellow transfer roller 19, each constitute the second image forming unit.

When the set of the magenta process unit 5M and the magenta transfer roller 19 is assumed to be the first image forming unit, the set of the cyan process unit 5C and the cyan transfer roller 19 and the set of black process unit 5K and the black transfer roller 19, which are disposed rearward of the set of the magenta process unit 5M and the magenta transfer roller 19, each constitute the second image forming unit.

When the set of the cyan process unit 5C and the cyan transfer roller 19 is assumed to be the first image forming unit, the set of the black process unit 5K and the black transfer roller 19, which is disposed rearward of the set of the cyan process unit 5 and the cyan transfer roller 19, constitute the second image forming unit.

In the low humidity environment, the charging bias to be applied to the first charging member is an example of a second charging bias, and the charging bias to be applied to the second charging member is an example of a third charging bias.

Specifically, when the set of the yellow process unit 5Y and the yellow transfer roller 19 is assumed to be the first image forming unit, the charging bias of +700 V to be applied to the yellow scorotron charger 12 is an example of the second charging bias; and the charging bias of +750 V to be applied to the magenta scorotron charger 12, the charging bias of +750 V to be applied to the cyan scorotron charger 12, and the charging bias of +800 V to be applied to the black scorotron charger 12 are each an example of the third charging bias.

When the set of the magenta process unit 5M and the magenta transfer roller 19 is assumed to be the first image forming unit, the charging bias of +750 V to be applied to the magenta scorotron charger 12 is an example of the second charging bias; and the charging bias of +750 V to be applied to the cyan scorotron charger 12, and the charging bias of +800 V to be applied to the black scorotron charger 12 are each an example of the third charging bias.

When the set of the cyan process unit 5 and the cyan transfer roller 19 is assumed to be the first image forming unit, the charging bias of +750 V to be applied to the cyan scorotron charger 12 is an example of the second charging bias, and the charging bias of +800 V to be applied to the black scorotron charger 12 is an example of the third charging bias.

(3) Operational Advantages of Fourth Embodiment (3-1) The printer 301 according to the fourth embodiment can obtain the same operational advantages described for the printer 1 according to the first embodiment.

8. Fifth Embodiment

A printer 401 as an image forming apparatus according to a fifth embodiment of the present invention will be described while referring to FIG. 6, wherein like parts and components are designated with the same reference numerals to avoid duplicating description. In the following description, only parts differing from those of the embodiment will be described in detail.

(1) Overview of Fifth Embodiment

In the first embodiment described above, the printer 1 is a direct tandem-type color printer.

Figure 6:
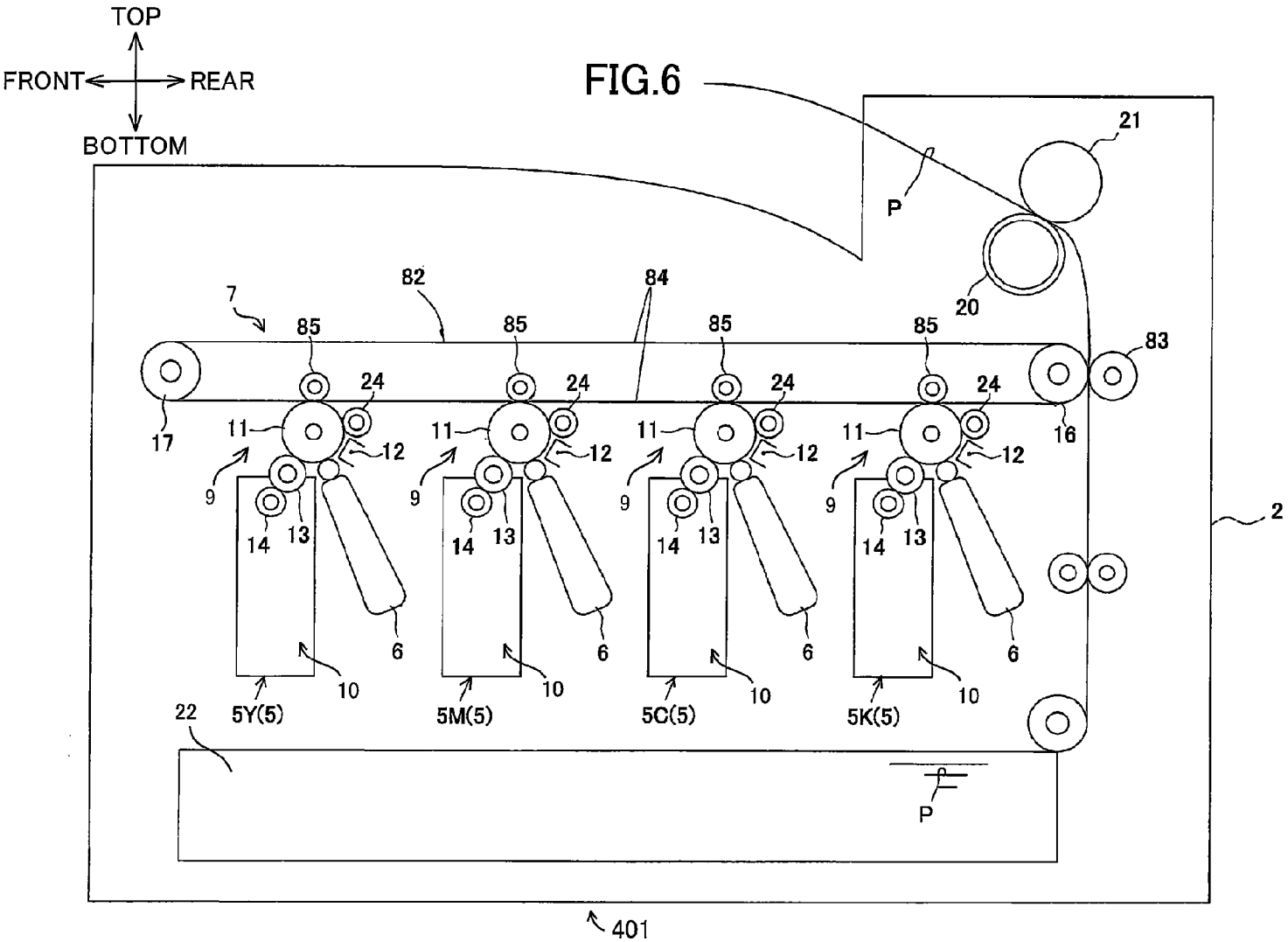
FIG. 6 is a cross-sectional view illustrating a printer according to a fifth embodiment of the present invention.

On the other hand, the printer 401 according to the fifth embodiment is an intermediate transfer type color printer, as illustrated in FIG. 6.

(2) Structure of Fifth Embodiment

In the printer 401 of the fifth embodiment, each scorotron charger 12 is disposed opposite to the corresponding photosensitive drum 11 from the lower-rear side thereof and spaced apart therefrom.

The drum cleaning roller 24 is disposed above the corresponding scorotron charger 12 at a rear side of the corresponding photosensitive drum 11.

The developing unit 10 is disposed at a lower-front side of the corresponding photosensitive drum 11.

The developing roller 13 is rotatably supported at an upper end portion of the developing unit 10 so as to be exposed upward through an upper edge of the developing unit 10 and contacts the corresponding photosensitive drum 11 from a lower-front side thereof.

The supply roller 14 is rotatably supported at the developing unit 10 and contacts the corresponding developing roller 13 from a lower-front side thereof.

The transfer unit 7 is disposed above and opposite to the plurality of process units 5. The transfer unit 7 includes a belt unit 82 and a secondary transfer roller 83.

The belt unit 82 includes the driving roller 16, the driven roller 17, an intermediate transfer belt 84 (transfer medium), and a plurality of primary transfer rollers 85.

The driving roller 16 is rotatably supported at a rear end portion of the belt unit 82.

The driven roller 17 is rotatably supported at a front end portion of the belt unit 82.

The intermediate transfer belt 84 is looped around the driving roller 16 and the driven roller 17 in such a manner that a lower portion of the intermediate transfer belt 84 contacts all the photosensitive drums 11 from above. When the driving roller 16 is driven to rotate, the intermediate transfer belt 84 circulates so that its lower portion moves rearward, and the driven roller 17 rotates along the circulating movement of the intermediate transfer belt 84.

Each of the plurality of primary transfer rollers 85 is disposed above and opposite to the corresponding photosensitive drum 11, with the lower portion of the intermediate transfer belt 84 interposed between the bottom of the primary transfer roller 85 and the top of the corresponding photosensitive drum 11.

Hereinafter, the primary transfer roller 85 corresponding to the yellow photosensitive drum 11 will be referred to as the yellow primary transfer roller 85; the primary transfer roller 85 corresponding to the magenta photosensitive drum 11 will be referred to as the magenta primary transfer roller 85; the primary transfer roller 85 corresponding to the cyan photosensitive drum 11 will be referred to as the cyan primary transfer roller 85; and the primary transfer roller 85 corresponding to the black photosensitive drum 11 will be referred to as the black primary transfer roller 85.

(3) Image Forming Operation in Fifth Embodiment

When a print job is inputted to the printer 401, toner accommodated in each developing unit 10 is tribo-charged between the supply roller 14 and the corresponding developing roller 13, and is then carried on a surface of the developing roller 13 at a thin uniform thickness.

In the meantime, each scorotron charger 12 applies a uniform charge to a surface of the corresponding photosensitive drum 11. Subsequently, the photosensitive drum 11 is exposed to light by the corresponding LED unit 6 based on predetermined image data. As a result, an electrostatic latent image based on the image data is formed on the surface of the photosensitive drum 11. The toner carried on the developing roller 13 is then supplied to the electrostatic latent image formed on the surface of the corresponding photosensitive drum 11. In this way, a toner image is carried on the surface of the photosensitive drum 11.

The toner images carried on the surfaces of the respective photosensitive drums 11 are sequentially transferred onto the lower portion of the intermediate transfer belt 84. As a result, a color image is formed on a surface of the intermediate transfer belt 84.

The sheets P are accommodated in the sheet supply tray 22 provided at the bottom portion of the main casing 2 and conveyed above and rearward by various rollers. The sheets P are supplied, one at a time, between the intermediate transfer belt 84 and the secondary transfer roller 83 by a predetermined timing. The sheet P then passes between the intermediate transfer belt 84 and the secondary transfer roller 83 from a lower side to an upper side thereof. At this time, the color image is transferred onto the sheet P.

The sheet P is subjected to heat and pressure while passing between the heating roller 20 and the pressure roller 21 of the fixing unit 8, thereby thermally fixing the color image onto the sheet P. Thereafter, the sheet P is discharged to the discharge tray 23.

(4) Setting of Transfer Current and Charging Bias

In the fifth embodiment, the charging bias controller 50 sets the charging bias to be applied individually to the plurality of scorotron chargers 12 in the same manner as in the first embodiment.

The transfer bias controller 48 sets the transfer current to be made to flow between each of the plurality of photosensitive drums 11 and its corresponding primary transfer roller 85 in the same manner as in the first embodiment.

(5) Operational Advantages of Fourth Embodiment

The printer 401 according to the fifth embodiment can obtain the same operational advantages described for the printer 1 according to the first embodiment.

9. Variations of Embodiments (1) Although the control substrate 42 includes the CPU in each of the above-described embodiments, the control substrate 42 may include an ASIC, i.e., an application specific integrated circuit, in place of the CPU.

(2) In each of the above-described embodiments, the residual toner adhered onto the photosensitive roller 11 may be collected also by means of the corresponding developing roller 13.

In this case, in a state where the surface potential of the photosensitive drum 11 is prevented from being excessively lowered due to an increase in the value of the transfer current, the residual toner adhered onto the photosensitive drum 11 can reliably be cleaned by means of the corresponding drum cleaning roller 24 and the corresponding developing roller 13.

(3) In each of the above-described embodiments, when continuous printing for the plurality of sheets P is instructed in the print job, the transfer bias controller 48 may increase the value of the transfer current and the charging bias controller 50 may increase the value of the charging bias, for the second and subsequent sheets P.

(4) Although the printer 1 is designed as a color printer in each of the above-described embodiments, the printer 1 may be designed as a monochromatic printer.

(5) The above-described embodiments may be combined each other to form another embodiment of the invention.

For example, the first, second, and third embodiments may be combined to one another.

Further, for example, to the fifth embodiment, at least one of the first, second, third, and fourth embodiments may be applied.

While the present invention has been described in detail with reference to the embodiment thereof, it would be apparent to those skilled in the art that various changes and modifications may be made therein without departing from the spirit of the present invention.

What is claimed is:

1. An image forming apparatus comprising:

an image forming unit comprising a first image forming unit and a second image forming unit; and a controller, the first image forming unit including:

a first image bearing member having a surface and configured to carry a first developer image on the surface of the first image bearing member;

a first charging member configured to apply an electric charge to the surface of the first image bearing member; and a first transfer member configured to transfer the first developer image carried on the surface of the first image bearing member to a transfer medium, the second image forming unit including:

a second image bearing member having a surface and configured to carry a second developer image on the surface of the second image bearing member;

a second charging member configured to apply an electric charge to the surface of the second image bearing member; and a second transfer member configured to transfer the second developer image carried on the surface of the second image bearing member to the transfer medium to be superposed on the first developer image, the transfer medium being conveyed from the first image forming unit to the second image forming unit, the controller being configured to selectively apply a plurality of transfer biases including a first transfer bias and a second transfer bias to each of the first transfer member and the second transfer member, the second transfer bias being larger than the first transfer bias, the controller being further configured to selectively apply a plurality of charging biases including a first charging bias, a second charging bias and a third charging bias to each of the first charging member and the second charging member, the first image bearing member having a first surface potential when the first charging bias is applied to the first charging member, the first image bearing member having a second surface potential higher than the first surface potential when the second charging bias is applied to the first charging member, the second image bearing member having the first surface potential when the first charging bias is applied to the second charging member, the second image bearing member having a third surface potential higher than the second surface potential when the third charging bias is applied to the second charging member, the controller applying the first charging bias to the first charging member and the second charging member when applying the first transfer bias to the first transfer member, and the controller applying the second charging bias to the first charging member and applying the third charging bias to the second charging member when applying the second transfer bias to the first transfer member.

2. The image forming apparatus as claimed in claim 1, further comprising:

a main casing; and a humidity sensor configured to measure a relative humidity inside the main casing, wherein the controller is configured to apply the first transfer bias and the first charging bias to the first transfer member and the first charging member, respectively, when the relative humidity measured by the humidity sensor is higher than a first predetermined value, and wherein the controller is configured to apply the second transfer bias and the second charging bias to the first transfer member and the first charging member, respectively, when the relative humidity measured by the humidity sensor is equal to or lower than the first predetermined value.

3. The image forming apparatus as claimed in claim 1, further comprising a resistance detector configured to detect an electric resistance of the transfer medium, wherein the controller is configured to apply the first transfer bias and the first charging bias to the first transfer member and the first charging member, respectively, when the electric resistance detected by the resistance detector is lower than a second predetermined value, and wherein the controller is configured to apply the second transfer bias and the second charging bias to the first transfer member and the first charging member, respectively, when the electric resistance detected by the resistance detector is equal to or higher than the second predetermined value.

4. The image forming apparatus as claimed in claim 1, further comprising a determination unit configured to determine a type of the transfer medium that receives the first developer image and the second developer image among a plurality of different types of transfer medium available for receiving the first developer image and the second developer image, wherein the controller is configured to apply the first transfer bias and the first charging bias to the first transfer member and the first charging member, respectively, when the determination unit determines that a first predetermined type of transfer medium is selected for receiving the first developer image and the second developer image, and wherein the controller is configured to apply the second transfer bias and the second charging bias to the first transfer member and the first charging member, respectively, when the determination unit determines that a second predetermined type of transfer medium is selected for receiving the first developer image and the second developer image.

5. The image forming apparatus as claimed in claim 1, wherein the first image bearing member is elongated and defines a maximum image formation area having a dimension in a direction in which the first image bearing member is elongated, the transfer medium having a length in the direction in which the first image bearing member is elongated, the image forming apparatus further comprising a determination unit configured to determine a ratio of the length of the transfer medium to the dimension of the maximum image formation area, wherein the controller is configured to apply the first transfer bias and the first charging bias to the first transfer member and the first charging member, respectively, when the ratio of the length of the transfer medium to the dimension of the maximum image formation area is more than a third predetermined value, and wherein the controller is configured to apply the second transfer bias and the second charging bias to the first transfer member and the first charging member, respectively, when the ratio of the length of the transfer medium to the dimension of the maximum image formation area is equal to or less than the third predetermined value.

6. The image forming apparatus as claimed in claim 1, wherein the first image forming unit further includes a first developer carrying member configured to carry developer and to supply the developer to the first image bearing member, the first developer carrying member being further configured to remove residual developer from the first image bearing member, and wherein the second image forming unit further includes a second developer carrying member configured to carry developer and to supply the developer to the second image bearing member, the second developer carrying member being further configured to remove residual developer from the second image bearing member.

7. The image forming apparatus as claimed in claim 1, wherein the first image forming unit further includes:

a first cleaning member configured to remove residual developer that remains on the surface of the first image bearing member after the first developer image has been transferred onto the transfer medium from the surface of the first image bearing member, wherein the second image forming unit further includes:

a second cleaning member configured to remove residual developer that remains on the surface of the second image bearing member after the second developer image has been transferred onto the transfer medium from the surface of the second image bearing member, and wherein a first transfer current flows between the first image bearing member and the first transfer member when the first transfer bias is applied to the first transfer member, and a second transfer current flows between the first image bearing member and the first transfer member when the second transfer bias is applied to the first transfer member.

8. The image forming apparatus as claimed in claim 1, wherein the image forming unit comprises a plurality of image forming units including the first image forming unit and the second image forming unit, and wherein the transfer medium is conveyed in a conveying direction from the first image forming unit to the second image forming unit, the second image forming unit being positioned most downstream of the plurality of image forming units in the conveying direction.

9. A method executed by an image forming apparatus including: an image forming unit including a first image forming unit and a second image forming unit; and a controller, the first image forming unit including: a first image bearing member having a surface and configured to carry a first developer image on the surface of the first image bearing member; a first charging member configured to apply an electric charge to the surface of the first image bearing member; and a first transfer member configured to transfer the first developer image carried on the surface of the first image bearing member to a transfer medium, the second image forming unit including: a second image bearing member having a surface and configured to carry a second developer image on the surface of the second image bearing member; a second charging member configured to apply an electric charge to the surface of the second image bearing member; and a second transfer member configured to transfer the second developer image carried on the surface of the second image bearing member to the transfer medium to be superposed on the first developer image, the transfer medium being conveyed from the first image forming unit to the second image forming unit, the method comprising:

selectively applying a plurality of transfer biases including a first transfer bias and a second transfer bias to each of the first transfer member and the second transfer member, the second transfer bias being larger than the first transfer bias; and selectively applying a plurality of charging biases including a first charging bias, a second charging bias, and a third charging bias to each of the first charging member and the second charging member, the first image bearing member having a first surface potential when the first charging bias is applied to the first charging member, the first image bearing member having a second surface potential higher than the first surface potential when the second charging bias is applied to the first charging member, the second image bearing member having the first surface potential when the first charging bias is applied to the second charging member, the second image bearing member having a third surface potential higher than the second surface potential when the third charging bias is applied to the second charging member, the first charging bias being applied to the first charging member and the second charging member when the first transfer bias is applied to the first transfer member, the second charging bias and the third charging bias being applied to the first charging member and the second charging member, respectively, when the second transfer bias is applied to the first transfer member.

10. A non-transitory computer readable storage medium storing a set of program instructions executed by a computer for controlling an image forming apparatus including: an image forming unit including a first image forming unit and a second image forming unit; and a controller, the first image forming unit including: a first image bearing member having a surface and configured to carry a first developer image on the surface of the first image bearing member; a first charging member configured to apply an electric charge to the surface of the first image bearing member; and a first transfer member configured to transfer the first developer image carried on the surface of the first image bearing member to a transfer medium, the second image forming unit including: a second image bearing member having a surface and configured to carry a second developer image on the surface of the second image bearing member; a second charging member configured to apply an electric charge to the surface of the second image bearing member; and a second transfer member configured to transfer the second developer image carried on the surface of the second image bearing member to the transfer medium to be superposed on the first developer image, the transfer medium being conveyed from the first image forming unit to the second image forming unit, the program instructions comprising:

selectively applying a plurality of transfer biases including a first transfer bias and a second transfer bias to each of the first transfer member and the second transfer member, the second transfer bias being larger than the first transfer bias; and selectively applying a plurality of charging biases including a first charging bias, a second charging bias, and a third charging bias to each of the first charging member and the second charging member, the first image bearing member having a first surface potential when the first charging bias is applied to the first charging member, the first image bearing member having a second surface potential higher than the first surface potential when the second charging bias is applied to the first charging member, the second image bearing member having the first surface potential when the first charging bias is applied to the second charging member, the second image bearing member having a third surface potential higher than the second surface potential when the third charging bias is applied to the second charging member, the first charging bias being applied to the first charging member and the second charging member when the first transfer bias is applied to the first transfer member, the second charging bias and the third charging bias being applied to the first charging member and the second charging member, respectively, when the second transfer bias being applied to the first transfer member.

* * * * *